US006855374B2

(12) United States Patent
Leonard

(10) Patent No.: US 6,855,374 B2
(45) Date of Patent: Feb. 15, 2005

(54) METHOD FOR IMPROVING THE UNIFORMITY OF A WET COATING ON A SUBSTRATE USING AT LEAST TWO WIRE-WOUND RODS

(75) Inventor: William K. Leonard, River Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 300 days.

(21) Appl. No.: 10/044,279

(22) Filed: Jan. 10, 2002

(65) Prior Publication Data

US 2002/0094384 A1 Jul. 18, 2002

Related U.S. Application Data

(63) Continuation-in-part of application No. 09/757,955, filed on Jan. 10, 2001, now Pat. No. 6,737,113.

(51) Int. Cl.[7] ..... B05D 1/28
(52) U.S. Cl. ..... 427/359; 427/286
(58) Field of Search ..... 427/355, 359, 427/444, 286; 118/100, 110, DIG. 15

(56) References Cited

U.S. PATENT DOCUMENTS

| | | | | |
|---|---|---|---|---|
| 1,043,021 A | | 10/1912 | Mayer | |
| 2,066,780 A | * | 1/1937 | Holt | 427/356 |
| 2,105,488 A | | 1/1938 | Massey et al. | |
| 2,105,981 A | | 1/1938 | Massey et al. | |
| 2,229,620 A | | 1/1941 | Bradner | |

(List continued on next page.)

FOREIGN PATENT DOCUMENTS

| | | |
|---|---|---|
| DE | 2304987 | 8/1974 |
| EP | 1088 595 A | 4/2001 |
| GB | 1 278 099 | 6/1972 |
| WO | WO 01/96661 A1 | 12/2001 |

OTHER PUBLICATIONS

Booth, G.L., "The Coating Machine", *Pulp and Paper Manufacture*, vol. 8. pp. 76–87, Third Edition, 1990.
Booth, G.L., *Evolution of Coating*, vol. 1, Gorham International Incorporated.
Gutoff, Edgar R. and Cohen, Edward D., "Problems Associated with Roll Coating an Related Processes", *Coating and Drying Defects*, pp. 74–95, 1995.
Benjamin, Dean F., Anderson, Todd J., and Scriven, L.E., "Multiple Roll Systems: Steady–State Operation", AIChE Journal, V41, pp. 1045–1060, 1995.

(List continued on next page.)

*Primary Examiner*—Shrive P. Beck
*Assistant Examiner*—William Phillip Fletcher, III
(74) *Attorney, Agent, or Firm*—Brian E. Szymanski

(57) ABSTRACT

Continuous void-free uniform coatings are formed on substrates by repeatedly contacting the substrate at a first position with wetted surface portions of at least two rotating wire-wound coating rods and re-contacting the substrate with such wetted surface portions at a different position or positions on the substrate. The coating is repeatedly picked up from and placed onto the substrate and made more uniform. Extremely uniform and extremely thin coatings can be quickly and easily obtained using low cost equipment.

28 Claims, 7 Drawing Sheets

U.S. PATENT DOCUMENTS

| | | | | | |
|---|---|---|---|---|---|
| 2,229,621 | A | | 1/1941 | Bradner | |
| 2,237,045 | A | | 4/1941 | Bradner | |
| 2,237,068 | A | | 4/1941 | Bradner | |
| 2,245,045 | A | | 6/1941 | Bradner | |
| 2,388,339 | A | | 11/1945 | Paxton et al. | |
| 2,977,243 | A | | 3/1961 | Meier | |
| 3,018,757 | A | | 1/1962 | Loppnow | |
| 3,169,081 | A | | 2/1965 | Nelson et al. | |
| 3,718,117 | A | * | 2/1973 | Lewicki, Jr. | 118/414 |
| 3,844,813 | A | * | 10/1974 | Leonard et al. | 427/173 |
| 3,920,862 | A | | 11/1975 | Damschroder et al. | |
| 4,020,194 | A | | 4/1977 | McIntyre et al. | |
| 4,102,301 | A | * | 7/1978 | Reade et al. | 118/67 |
| 4,267,215 | A | | 5/1981 | Riggs | |
| 4,344,989 | A | * | 8/1982 | Thornton et al. | 427/286 |
| 4,354,449 | A | | 10/1982 | Zink | |
| 4,378,390 | A | | 3/1983 | Yoshida et al. | |
| 4,569,864 | A | | 2/1986 | McIntyre | |
| 4,748,043 | A | | 5/1988 | Seaver et al. | |
| 4,830,873 | A | | 5/1989 | Benz et al. | |
| 5,326,598 | A | | 7/1994 | Seaver et al. | |
| 5,332,797 | A | | 7/1994 | Kessel et al. | |
| 5,409,732 | A | | 4/1995 | Leonard et al. | |
| 5,447,474 | A | | 9/1995 | Chang | |
| 5,460,120 | A | | 10/1995 | Paul et al. | |
| 5,536,314 | A | | 7/1996 | Rannestad | |
| 5,585,545 | A | | 12/1996 | Bennett et al. | |
| 5,599,602 | A | | 2/1997 | Leonard et al. | |
| 5,620,514 | A | | 4/1997 | Munter et al. | |
| 5,702,527 | A | | 12/1997 | Seaver et al. | |
| 5,733,608 | A | | 3/1998 | Kessel et al. | |
| 5,871,585 | A | | 2/1999 | Most et al. | |
| 5,954,907 | A | | 9/1999 | LaRose et al. | |
| 6,117,237 | A | | 9/2000 | Yapel et al. | |

OTHER PUBLICATIONS

Benjamin, Dean F., Anderson, Todd J., and Scriven, L.E., "Multiple Roll Systems: Residence Times and Dynamic Response", AlChE Journal, V41, pp. 2198–2211, 1995.

http://www.ferron–magnetic.co.uk/coatings/meterrod.htm.

U.S. Appl. No. 09/757,955, filed Jan. 10, 2001, "Coating Device and Method", pp 1–47 (20 sheets of drawings).

U.S. Appl. No. 09/841,380, filed Apr. 24, 2001, "Electrostatic Spray Coating Apparatus and Method", pp. 1–46 (17 sheets of drawings).

U.S. Appl. No. 09/841,381, filed Apr. 24, 2001, "Variable Electrostatic Spray Coating Apparatus and Method", pp. 1–44 (17 sheets of drawings).

U.S. Appl. No. 10/044,237, filed Jan. 10, 2002, "Coating Device and Method Using Pick–and–Place Deives having Equal or Substanially Equal Periods", pp. 1–58 (38 sheets of drawings).

U.S. Appl. No. 10/044,276, filed Jan. 10, 2002, "Sheet Coater", pp. 1–28 (13 sheets of drawings).

Merriam–Webster's Collegiate Dictionary, Tenth Edition, Copyright© 1998, definition of "smooth" and definition of "uniform".

* cited by examiner

METHOD FOR IMPROVING THE UNIFORMITY OF A WET COATING ON A SUBSTRATE USING AT LEAST TWO WIRE-WOUND RODS

CROSS-REFERENCE TO RELATED APPLICATION

This application is a continuation-in-part of U.S. patent application Ser. No. 09/757,955 filed Jan. 10, 2001, entitled COATING DEVICE AND METHOD (now U.S. Pat. No. 6,737,113 B1), the entire disclosure of which is incorporated by reference herein.

FIELD OF THE INVENTION

This invention relates to devices and methods for coating substrates and for improving the uniformity of non-uniform or defective coatings.

BACKGROUND

There are many known methods and devices for coating a moving web and other fixed or moving substrates. For example, a wire-wound rod coater known as a "Mayer Bar" (see U.S. Pat. No. 1,043,021 to Mayer) can be used to make manual hand spreads on small test sheets. Papermaking and paper coating machines have been constructed by including a wire-wound coating rod (sometimes referred to as a "scraper rod") on one or both sides of the paper web, as shown in Booth, G. L., "The Coating Machine", *Pulp and Paper Manufacture,* Vol. 8, *Coating, Converting and Processes,* pp 76–87 (Third Edition, 1990; see the "Champion Rod Coater" at page 78); Booth, G. L., Evolution of Coating, Vol. 1, (Gorham International Inc.); U.S. Pat. Nos. 1,043,021, 2,229,620, 2,229,621, 2,237,068 and 2,245,045; and at http://www.ferron-magnetic.co.uk/coatings/meterrod.htm. Sometimes the wire-wound coating rod in such machines is slowly rotated during coating, in order to equalize wear on the wire.

Devices for coating substrates of limited length (e.g., small sheets) are also available, and can be used to prepare experimental or test coatings without requiring set up or operation of a web coating apparatus. These typically consist of a knifing apparatus in which a gap is set between a knifing edge and a bed plate, and a sheet is pulled through the gap while it is flooded with coating liquid.

SUMMARY OF THE INVENTION

The above-mentioned '113 Patent describes coating devices and methods in which repeating and random coating defects are eliminated or at least significantly reduced trough the use of pick-and-place contacting devices. Rotating rolls (and especially undriven rolls that can co-rotate with a coated substrate as it passes byte rolls) are a preferred typo of pick-and-place device in the '113 Patent. Especially preferred are differently sized rolls, or rolls operated at different speeds, with the sizes or speeds (and thus the periods of contact, defined as the time between successive contacts by a point on the device with the substrate) not being periodically related to one another. The uniformity of a coating on a substrate is improved by contacting the coating at a first position with the wetted surfaces of the periodic pick-and-place devices, and re-contacting the coating wit such wetted surfaces at positions on the substrate that are different from to first position and not periodically related to one another with respect to their distance from the first position. The coating devices and methods of the '113

Patent can provide extremely uniform coatings and extremely thin coatings, at very high rates of speed.

Pending U.S. patent application Ser. No. 10/044.237 filed even date herewith and entitled COATING DEVICE AND METHOD USING PICK-AND-PLACE DEVICES HAVING EQUAL OR SUBSTANTIALLY EQUAL PERIODS, the entire disclosure of which is incorporated by reference herein, describes additional coating devices and methods using pick-and-place devices whose periods of contact with a substrate are equal or substantially equal to one another.

Both these pending Applications state that in coating situations involving thicker applied coatings, it may be useful to groove, knurl, etch or otherwise texture the surfaces of one or more (or even all) of the pick-and-place devices so that they can accommodate the increased wet coating thickness. The present invention involves the use of a plurality of wire-wound coating rods as pick-and-place devices in coating devices and methods such as those described in these pending Applications. Wire-wound coating rods are widely available at low cost, and yield a coating device having very good performance. The applied coating can be carefully metered without waste or excess. The final coating weight can be easily fine-tuned. The formation of uncontrolled rolling banks of coating liquid at the coating rods is discouraged.

Accordingly, in one aspect, the present invention provides a method for improving the uniformity of a wet coating on a substrate comprising contacting the coating at a first position with wetted surface portions of at least two rotating wire-wound coating rods and re-contacting the coating with such wetted surface portions at a different position or positions on the substrate.

The invention also provides devices for carrying out the methods of the invention. In one aspect, the invention provides a device comprising two or more rotating wire-wound coating rods that periodically contact and re-contact a wet coating at different positions on a substrate, wherein the periods of the devices are selected so that the uniformity of the coating is improved. In another aspect, the invention provides a coating apparatus comprising a coating station that applies an uneven (and preferably discontinuous) coating to a substrate and an improvement station comprising two or more rotating wire-wound coating rods that contact and re-contact the coating at a different position or positions on the substrate. In yet a further aspect, the invention provides a coating apparatus comprising a coating station that applies an uneven (and preferably discontinuous) coating to a first substrate, an improvement station comprising two or more rotating wire-wound coating rods that contact and re-contact the coating at a different position or positions on the first substrate, and a transfer station for transferring the coating from the first substrate to a second substrate.

The methods and devices of the invention also facilitate much more rapid drying of wet coatings on a substrate. Thus in another aspect, the methods of the invention further comprise drying the coating by contacting and re-contacting the coating with a plurality of rotating wire-wound coating rods, and the devices of the invention include a drying station having a plurality of rotating wire-wound coating rods that contact and re-contact a substrate having a wet coating.

The devices and methods of the invention facilitate the formation of continuous void-free, uniform and extremely thin coatings using low-cost equipment.

DETAILED DESCRIPTION

The invention is especially useful for, but not limited to, coating moving endless (or essentially endless) webs and belts. For brevity and unless the context requires otherwise, such a web or belt will be collectively referred to herein as a "web". The invention can also be used to coat substrates of limited length. For brevity and unless the context requires otherwise, such a substrate will be referred to herein as a "sheet". The web or sheet (which can collectively be referred to as a "substrate") can be previously uncoated, can have a previously-applied hardened coating, or can have a previously-applied and unhardened wet coating.

In the present invention, a wet coating is applied to or is already carried on the substrate and is made more uniform in caliper by the action of a plurality of rotating wire-wound coating rods, e.g., Mayer Bar coating rods. The coating rods act upon the wet coating while the substrate and coating rods are in relative motion with respect to one another. Usually this relative motion is supplied by moving a web over the coating rods or by mounting a sheet on a rotating support and nipping the coating rods against the sheet. The coating rods can rotate at the same peripheral speed as the substrate, or at a lesser or greater speed. If desired, the coating rods can rotate in a direction opposite to the motion of the substrate. Preferably, for applications involving the improvement of a coating on a substrate having a direction of motion, the direction of rotation of at least one of the coating rods is the same as the direction of substrate motion. More preferably, the direction of rotation of at least two of the coating rods is the same as the direction of substrate motion. Most preferably, all the coating rods rotate in the same direction as and at substantially the same speed as the substrate. This can conveniently be accomplished by using co-rotating undriven coating rods that bear against the substrate and are carried with the substrate in its motion.

Figure 1:
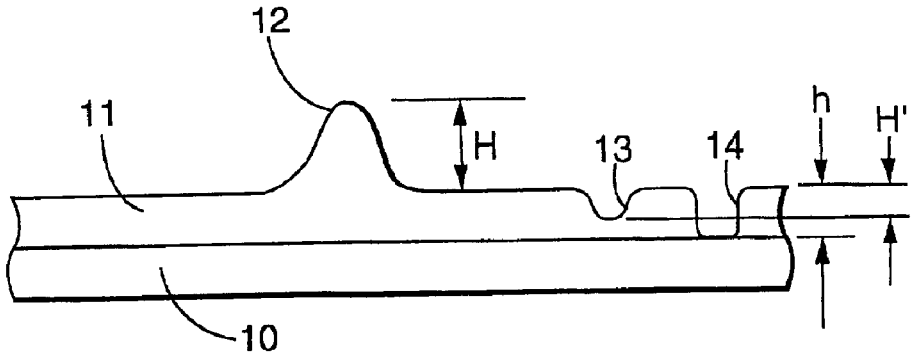
FIG. 1 is a schematic side view of coating defects on a web.

Referring now to FIG. 1, a coating of liquid 11 of nominal caliper or thickness h is present on a web 10. If a random local spike 12 of height H above the nominal caliper is deposited for any reason, or if a random local depression (such as partial cavity 13 of depth H' below the nominal caliper or void 14 of depth h) arises for any reason, then a small length of the coated substrate will be defective and not useable.

Figure 2:
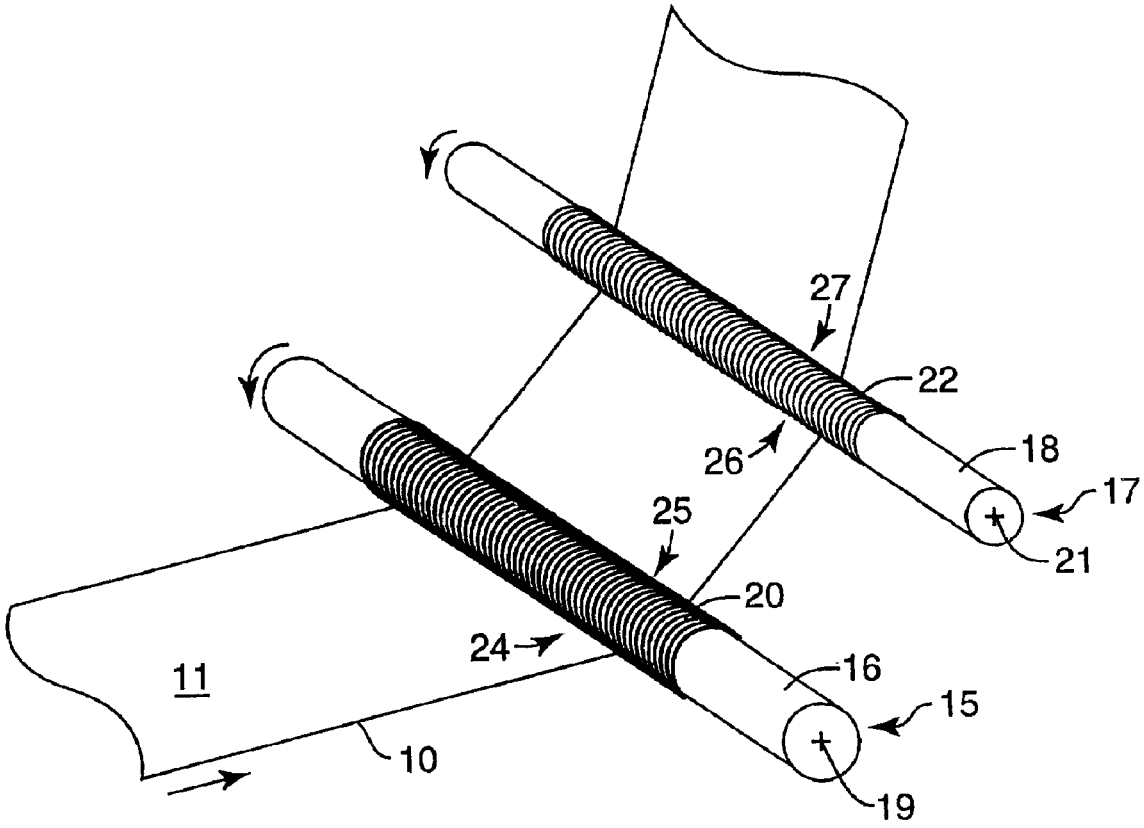
FIG. 2 is a perspective view of a device of the invention in which a coating on an endless web contacts two wire-wound coating rods.

FIG. 2 shows coating liquid 11 on moving web 10 as it contacts co-rotating wire-wound coating rods 15 and 17. Coating rod 15 has a central shaft 16 around which wire 20 is wrapped in spiral fashion. Coating rod 15 extends across the coated width of moving web 10. Coating rod 15 is undriven and co-rotates with the motion of web 10 about central axis 19. Coating rod 17 has a central shaft 18 around which wire 22 is wrapped in spiral fashion. As shown in FIG. 2, coating rod 17 has a smaller diameter than coating rod 15, but can have a larger or equal diameter if desired. As with coating rod 15, coating rod 17 extends across the coated width of web 10, is undriven, and co-rotates with the motion of web 10 about central axis 21. Following startup of the equipment and a few revolutions of coating rods 15 and 17, the wire-covered surfaces of coating rods 15 and 17 become wet with coating liquid 11 transferred from web 10. Coating liquid 11 fills the coating rod contact zones between entry point 24 and liquid split point 25, and between entry point 26 and liquid split point 27. At the split points, some coating liquid stays on web 10 and some stays on coating rod 15 or 17 as the coating rods continue to rotate and web 10 translates past coating rods 15 and 17. Upon completing a revolution, coating rods 15 and 17 each place the split liquid at new longitudinal positions on web 10. In this manner, portions of a liquid coating can be picked up from one web position and placed down on a web at another position and at another time. Both the coating rods 15 and 17 produce this action.

The coating rods can if desired be brought into contact with coating 11 only upon appearance of a defect. Alternatively, the coating rods can contact coating 11 whether or not a defect is present at the point of contact. Preferably, the rotating coating rods remain in continuous contact with the substrate, with any given portion of the wire-wound coating rod surface periodically contacting and re-contacting the substrate.

Only two coating rods are shown in FIG. 2. However, preferably more than two coating rods (e.g., 3, 4, 5, 10 or even 20 or more coating rods) are employed. When the coating-wetted surfaces of a plurality of rotating wire-wound coating rods such as coating rods 15 and 17 are brought into contact with a wet liquid coating such as coating 11, then excess coating such as spike 12 of FIG. 1 is picked off and placed at other positions on the substrate. These other positions can include positions having a deficiency of coating such as cavity 13 or void 14 of FIG. 1, and positions having a lower than average coating caliper. This pick-and-place action produces a more uniform coating. The use of wire-wound pick-and-place coating rods enables the applied coating to be carefully premetered without waste or excess. Thus the final coating weight can be easily fine-tuned. The formation of uncontrolled rolling banks of coating liquid at the input or output side of the coating rods is prevented or discouraged.

The periods of rotation of the coating rods preferably are chosen so that their actions do not reinforce coating defects along the substrate. The period of a rotating coating rod can be expressed in terms of the time required for the coating rod to pick up a portion of wet coating from one position along a substrate and then lay it down on another position, or by the distance along the substrate between two consecutive contacts by a surface portion of the coating rod. For example, if coating rod 15 is rotated at 60 rpm and the relative motion of substrate 10 with respect to coating rod 15 remains constant, then the period is one second. The invention employs a plurality of such rotating coating rods, preferably having two or more, and more preferably three or more different periods. By using a suitable number of coating rods and appropriately selecting their periods of contact with the substrate, extremely uniform coatings can be obtained at extremely high rates of speed. Most preferably, pairs of such periods are not related as integer multiples of one another.

The period of a rotating coating rod can be altered in many ways. For example, the period can be altered by changing the speed of rotation; by repeatedly (e.g., continuously) translating the coating rod along the length of the substrate (e.g., up web or down web) with respect to its initial spatial position as seen by a fixed observer; or by changing the translational speed of the substrate relative to the speed of rotation of a rotating coating rod. The period does not need to be a smoothly varying function, and does not need to remain constant over time.

The coating rods do not have to have different periods. The invention can also employ a large number of coating rods having the same or substantially the same placement periods, that is, coating rods whose placement periods are the same to a desired degree of precision. That desired degree of precision will vary depending on the overall number of such coating rods and upon the desired coating caliper uniformity. In general, the more coating rods employed, the better the results obtained at a given degree of precision in placement periods. For example, the periods can be within ±0.01%, ±0.05%, ±0.1%, ±0.5% or ±1% of one another, with greater precision (e.g., ±0.05%) in the periods of a large number of coating rods providing results that will in a general correspond to those obtainable using less precision (e.g., ±0.5%) in the periods of a smaller number of coating rods. When a discontinuous or deliberately uneven coating is initially applied to the substrate, a large number of equal or substantially equal period coating rods may be employed to achieve a uniform caliper coating. Preferably the period of the coating discontinuity or unevenness is selected or controlled to provide a uniform coating following passage past such coating rods. When the initial coating non-uniformity is in the form of stripes, then it is preferred to control or select the stripe width, or both the stripe width and stripe period, or each of the stripe width, stripe period and rod period in order to obtain the desired degree of caliper uniformity in the final coating.

Further details regarding the basic principles of operation of the devices of the invention are shown in detail in the above-mentioned '113 Patent and '237 Application.

Figure 3:
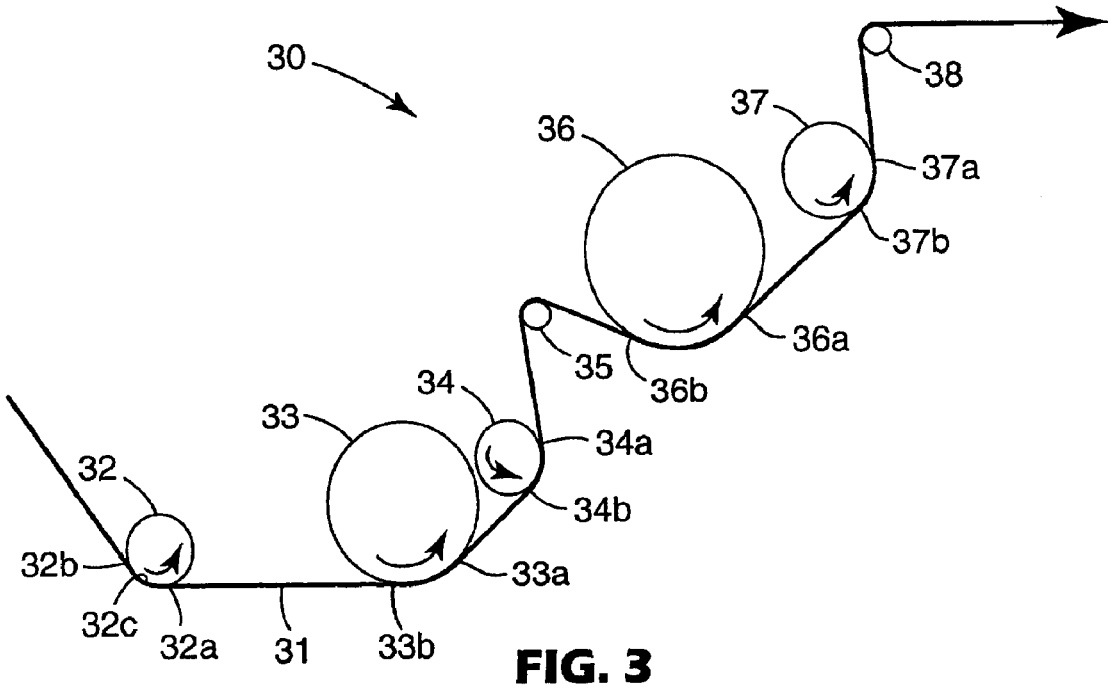
FIG. 3 is a schematic side view of a device of the invention that employs a set of five undriven co-rotating wire-wound coating rods.

FIG. 3 shows a schematic side view of a device 30 of the invention that employs a train of five undriven co-rotating wire-wound coating rods. The train of coating rods can be referred to as an "improvement station". The coating rods act to improve the caliper uniformity of a wet coating on the upper surface of web 31. The coating was applied to web 31 prior to entry of web 31 into improvement station 30 using a coating device not shown in FIG. 3. Liquid coating caliper on web 31 spatially varies in the down-web direction at any instant in time as it approaches wire-wound coating rod 32. To a fixed observer, the coating caliper would exhibit time variations. This variation may contain transient, random, periodic, and transient periodic components in the down web direction. Web 31 is directed along a path through station 30 and into contact with the wire-wound coating rods 32, 33, 34, 36 and 37 by idler rolls 35 and 38. The path is chosen so that the wet coated side of the web comes into physical contact with the wire-wound coating rods. Wire-wound coating rods 32 and 34 have the same diameter. The diameters of wire-wound coating rods 34, 36 and 37 are all different from one another and from the diameters of coating rods 32 and 34. Each of the coating rods is undriven and is rotated by the motion of web 31.

Referring for the moment to wire-wound coating rod 32, the liquid coating splits at lift off or split point 32*a*. A portion of the coating travels onward with the web and the remainder travels with coating rod 32 as it rotates away from lift off point 32*a*. Variations in coating caliper just prior to lift off point 32*a* are mirrored in both the liquid caliper on web 31 and the liquid caliper on the surface of coating rod 32 as web 31 and coating rod 32 leave lift off point 32*a*. After the coating on web 31 first contacts coating rod 32 and coating rod 32 has made one revolution, the liquid on coating rod 32 and incoming liquid on web 31 meet at the initial contact point 32*b*, thereby forming a liquid filled nip region 32*c* between points 32*b* and 32*a*. Region 32*c* is without air entrainment. To a fixed observer, the flow rate of the liquid entering this nip contact region 32*c* is the sum of the liquid entering on the web 31 and the liquid entering on the coating rod 32. The net action of coating rod 32 is to pick material from web 31 at one position and place a portion of the material down again at another position. In a similar fashion, the liquid coating splits at lift off points 33*a*, 34*a*, 36*a* and 37*a*, and a portion of the coating re-contacts web 31 at contact points 33*b*, 34*b*, 36*b* and 37*b* and is reapplied thereto. The net result is a more even coating on the web exiting improvement station 30.

A random severe initial defect (e.g., a large coating surge, or a complete absence of coating) can be significantly diminished by an improvement station of the invention. The input defects can be diminished to such an extent that they are no longer objectionable. By using the methods and devices of the invention, a new down web coating profile can be created at the exit from the improvement station. That is, by using multiple coating rods, the multiple defect images that are propagated and repropagated by the first coating rod are modified by additional multiple defect images that are propagated and repropagated by the second and any subsequent coating rods. This can occur in a constructively and destructively additive manner so that the net result is a more uniform caliper or a controlled caliper variation. In effect, multiple waveforms are added together in a manner so that the constructive and destructive addition of each waveform combines to produce a desired degree of uniformity. Viewed somewhat differently, when a coating upset passes through the improvement station a portion of the coating from the high spots is in effect picked off and placed back down in the low spots.

Figure 4:
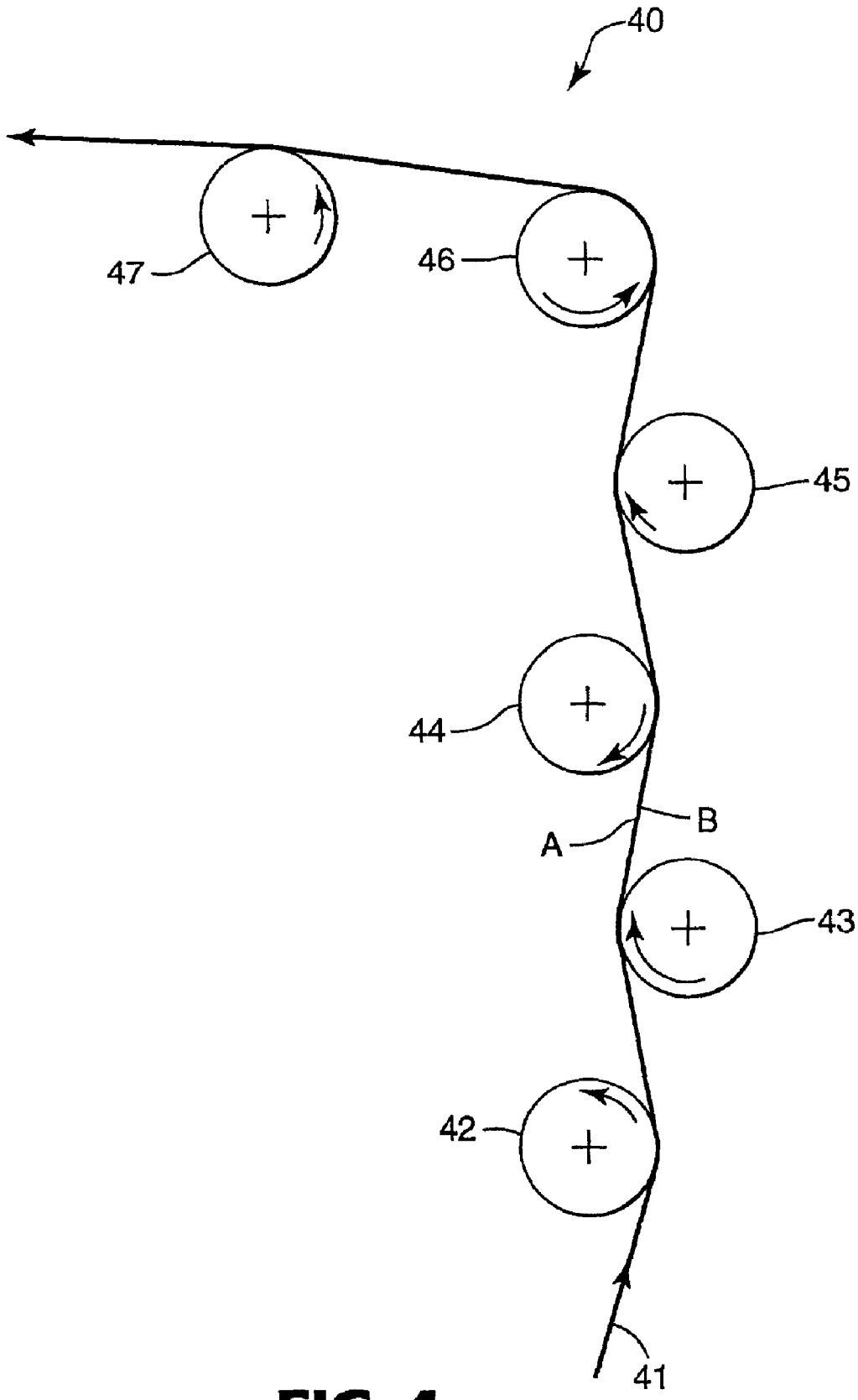
FIG. 4 is a schematic side view of a device of the invention that employs a set of six driven wire-wound coating rods.

FIG. 4 is a schematic side view of a device of the invention that employs a set of six driven wire-wound coating rods. Web 41 has been coated on both sides prior to entering improvement station 40 using a coating device not shown in FIG. 4. The two coated-sides are designated as A and B in FIG. 4. Web 41 is directed along a path through station 40 and into contact with the wire-wound coating rods 42, 43, 44, 45, 46 and 47. The path is chosen so that coated side A comes into physical contact with coating rods 42, 44, 46 and 47 and coated side B comes into physical contact with coating rods 43 and 45. As shown in FIG. 4, each of coating rods 42, 43, 44, 45, 46 and 47 has the same diameter. On coated side A, coating rods 42, 46 and 47 are driven so that they rotate with web 41 but at speeds that vary with respect to one another, and coating rod 44 is driven so that it rotates in a direction opposite to the direction of motion of web 41. The rotational speeds of coating rods 42, 44, 46 and 47 are adjusted to provide an improvement in coating uniformity on coated side A. Likewise, on coated side B, coating rod 43 is driven so that it rotates with web 41 and coating rod 45 is driven so that it rotates in a direction opposite to the direction of motion of web 41. The rotational speeds of coating rods 43 and 45 are adjusted to provide an improvement in coating uniformity on coated side B.

Figure 5:
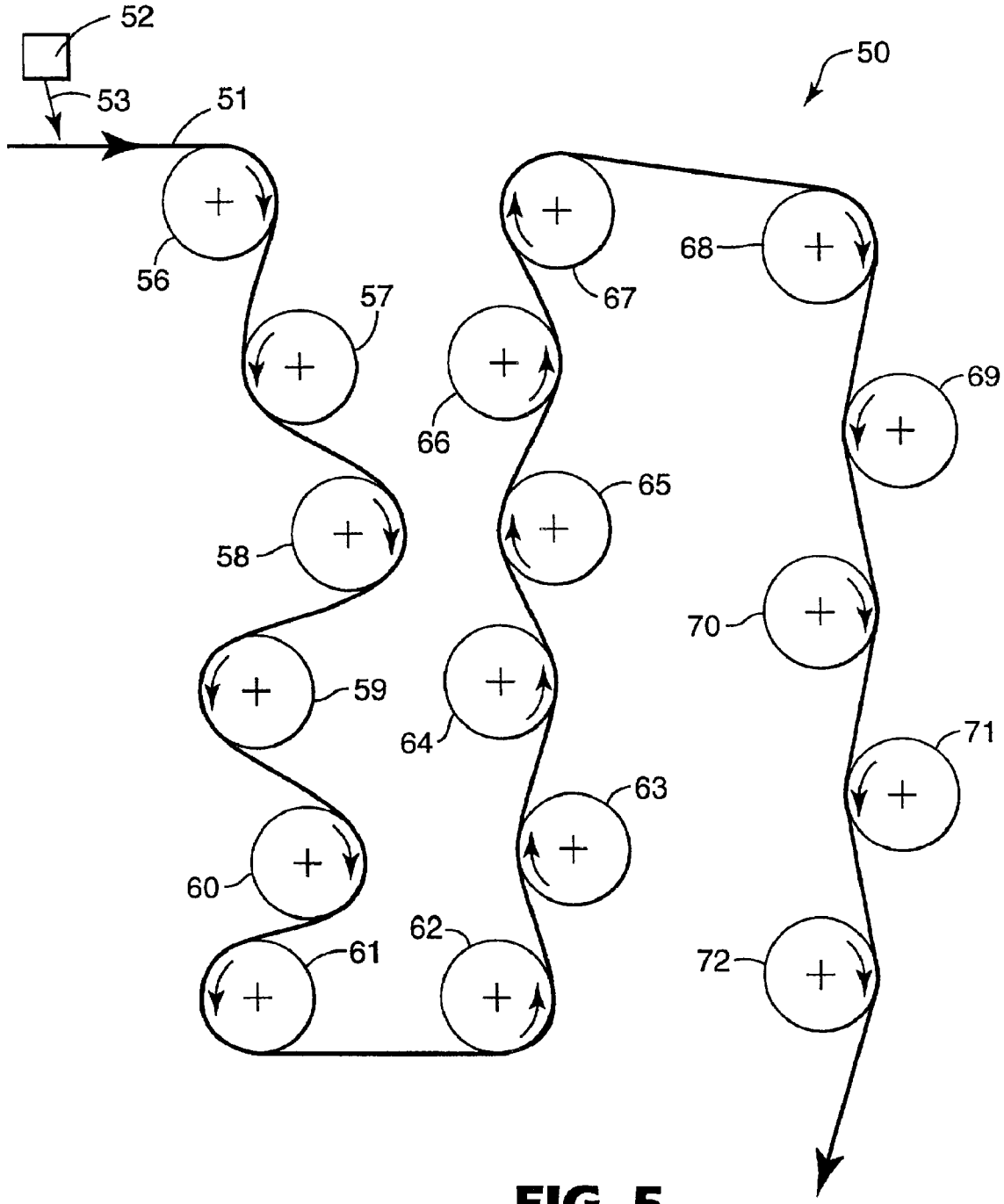
FIG. 5 is a schematic partial side view of a portion of a device of the invention that employs a set of twenty undriven co-rotating wire-wound coating rods.

FIG. 5 is a schematic partial side view of a uniformity improvement station 50 that uses a train of twenty wire-wound coating rods, eight of which are shown in FIG. 5. Liquid-coated web 51 is coated on its upper surface with an intermittent pattern of back-and-forth stripes applied from oscillating coating applicator 52 through flexible needle 53. The outlet end of needle 53 contacts web 51 and sweeps back and forth across the width of web 51. The oscillation rate and liquid flow rate through needle 53 determine the thickness and spacing of the stripes entering the improvement station 50. The oscillation rate and liquid flow rate also determine the final coating caliper on web 51 after exiting improvement station 50. The liquid coating caliper on web 51 varies considerably in the down-web direction at any instant in time as it approaches idler roll 56 and rotating wire-wound coating rod 57. To a fixed observer, the coating caliper would exhibit time variations and discontinuities. Web 51 is directed along a path through station 50 and into contact with the wire-wound coating rods 57, 59, 61, 62, 64, 66, 69 and 71 by idler rolls 56, 58, 60, 63, 65, 67, 68, 70 and 72. Wire-wound coating rods 57, 59, 61, 62, 64, 66, 69 and 71 (which as shown in FIG. 5 all have the same diameter) are undriven and co-rotate with the motion of web 51. Web 51 continues past an additional 12 coating rods (and additional idler rolls as needed) not shown in FIG. 5. By appropriately adjusting or selecting the period of rotation of the rolls and the width of the stripes, the coating can be made much more uniform.

Figure 6:
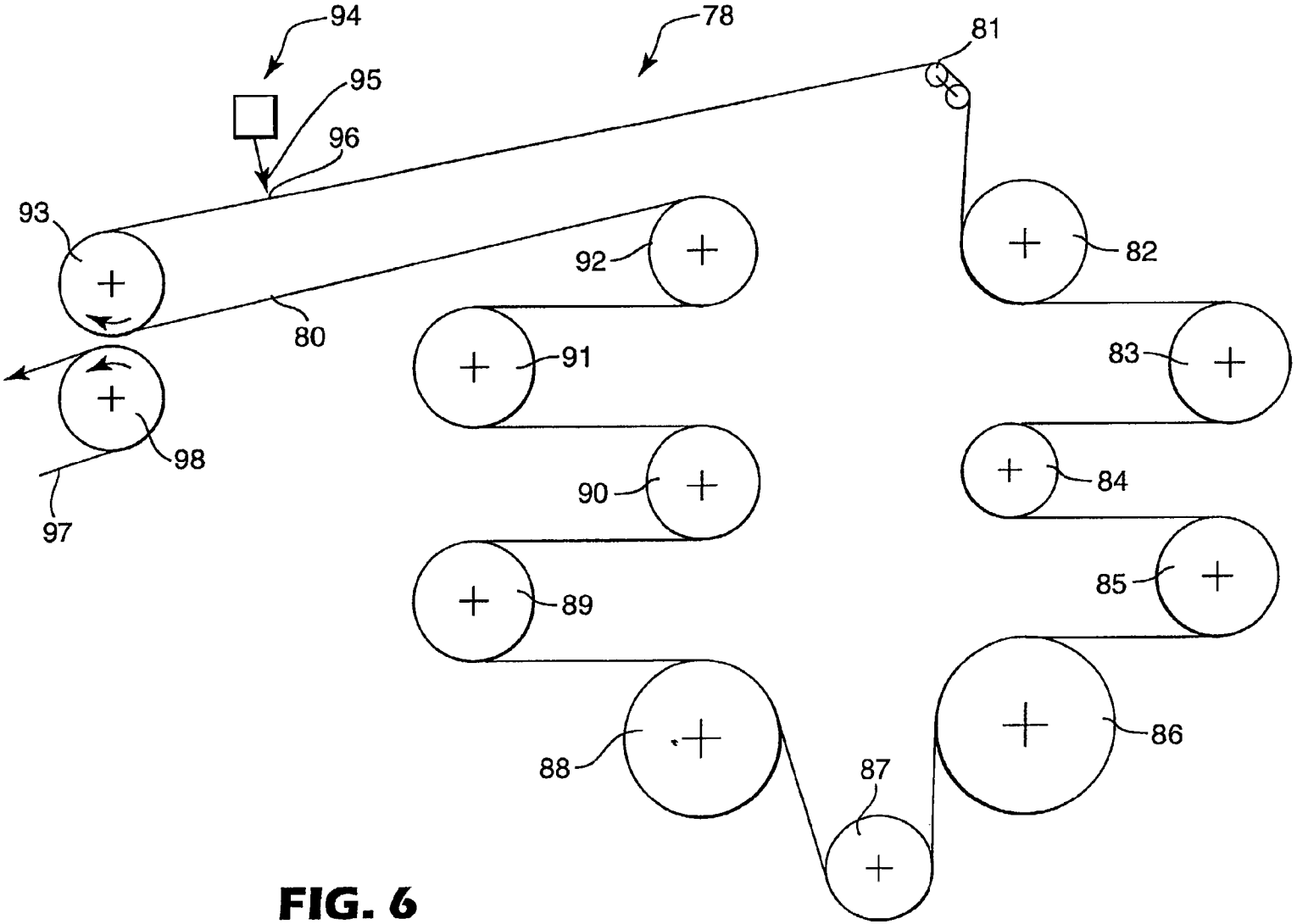
FIG. 6 is a schematic side view of a device of the invention that employs a transfer belt.

FIG. 6 is a schematic side view of a device 78 of the invention that employs a transfer belt 80. Belt 80 circulates on steering unit 81; idlers 83, 85, 87, 89, and 91; undriven co-rotating wire-wound coating rods 82, 84, 86, 88, 90 and 92; and driven back-up roll 93. Coating rods 82, 84, 86, 88, 90 and 92 have different diameters and different periods of rotation. Intermittent coating station 94 oscillates a flexible needle 95 back and forth across belt 80 at stripe coating region 96. The applied stripe forms a zig-zag pattern upset across belt 80, thereby creating an intermittent coating defect downstream from station 94. Following startup of the equipment and a few rotations of belt 80, belt 80 and coating rods 82, 84, 86, 88, 90 and 92 will become wet across their surfaces. The coating on the belt between coating rod 92 and back-up roll 93 will become very uniform. The embodiment of FIG. 6 as so far described can be used to produce a uniform coating on the belt itself, or to improve coating uniformity on a previously coated belt. The wet belt 80 can also be used to transfer the coating to a target web substrate 97. For example, target web 97 can be driven by powered roll 98 and brought into contact with belt 80 as belt 80 circulates around back-up roll 93. To coat web 97, rolls 93 and 98 are nipped together, thus forcing belt 80 into face-to-face contact with web 97. Upon passing from this nip point, some portion of the liquid coating will separate from belt 80 and be transferred to the surface of web 97. When using the device to continuously coat the target web 97, liquid is preferably constantly added to belt 80 at region 96 on each revolution of the belt, and continuously removed at the nip point between rolls 93 and 98. Because following startup, belt 80 will already be coated with liquid, there will not be a three phase (air, coating liquid and belt) wetting line at stripe coating region 96. This makes application of the coating liquid much easier than is the case for direct coating of a dry web. Since only about one half the liquid is transferred at the 93, 98 roll nip, the percentage of caliper non-uniformity downstream from region 96 will generally be much smaller (e.g., by as much as much as half an order of magnitude) than when stripe coating a dry web without a transfer belt and passing the thus-coated web through an improvement station of the invention having the same number of coating rods.

When the amount of liquid necessary for the desired average coating caliper is applied intermittently to wet belt 80 or to some other target substrate, the period and number of wire-wound coating rods preferably is chosen to accommodate the largest spacing between any two adjacent, down web deposits of coating. A significant advantage of such a method is that it is often easy to produce heavy cross web stripes or zones of coating on a belt or other target substrate but difficult to produce thin, uniform and continuous coatings. Another important attribute of such a method is that it has pre-metering characteristics, in that coating caliper can be controlled by adjusting the amount of liquid applied to the belt or other target substrate.

Although a speed differential can be employed between belt 80 and any of the coating rods shown in FIG. 6, or between belt 80 and web 97, preferably no speed differential is employed between belt 80 and coating rods 82, 84, 86, 88, 90 and 92, or between belt 80 and web 97. This simplifies the mechanical construction of the device. Web 97 may also be driven (e.g., by roll 98) in counter rotation to belt 80.

Figure 7:
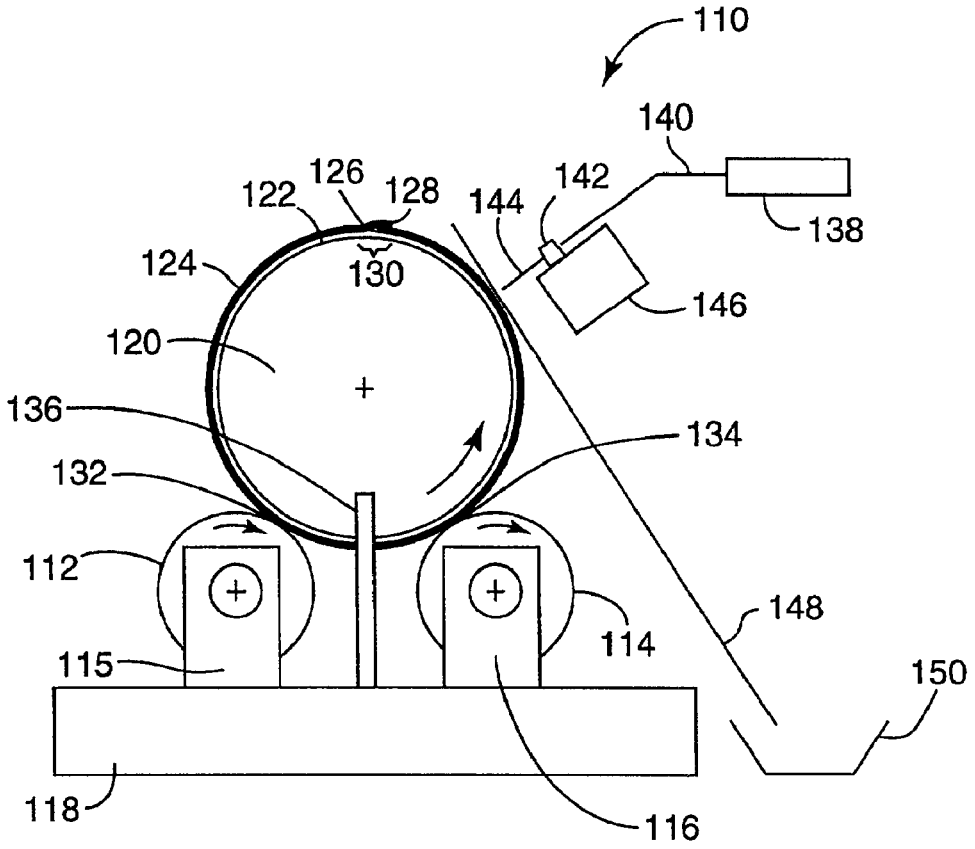
FIG. 7 is a schematic side view of a device of the invention for coating substrates of limited length.

FIG. 7 shows a device 100 of the invention for coating substrates of limited length. Wire-wound coating rods 112 and 114 are supported by low friction bearings (not shown in FIG. 7) housed in pedestals 115 and 116 atop base 118. Coating rods 112 and 114 are spaced horizontally from one another and in parallel. In the embodiment shown in FIG. 7, coating rods 112 and 114 are the same size. If desired, the coating rods can have different sizes. In addition, more than two coating rods can be employed. Coating rod 112 or 114 or both can be driven at speeds of, e.g., 1 to 1000 revolutions per minute by a variable drive device not shown in FIG. 7. Rotating support or mounting roll 120 is surrounded by rubber cover 122 and sheet 124. Sheet 124 has a limited length, and ends 126, 128 of sheet 124 overlap slightly at region 130. Roll 120 rests in the gap between and is supported by coating rods 112 and 114. The diameters and axes of coating rods 112 and 114 and of mounting roll 120 preferably are carefully controlled and aligned, with diameters and straightness tolerances of ±10 micrometers being preferred. The weight of roll 120 provides a nipping force that promotes intimate contact between sheet 124 and coating rods 112 and 114 in nip points 132 and 134. Retainer stop 136 and an additional retainer stop (not shown in FIG. 7) on the other end of roll 120 prevent sideways axial movement of roll 120. When driven coating rod 112 rotates, coating rod 114 and roll 120 are driven by surface traction at nearly the same surface speed as coating rod 112.

Coating liquid from syringe pump 138 is supplied through supply line 140 and feed block 142 to needle 144. Oscillating mechanism 146 moves needle 144 back and forth across the surface of roll 120. Rest positions are provided at each end of the oscillation stroke. Deflector plate 148 and an additional deflector plate (not shown in FIG. 7) on the other end of roll 120 intercept the flow of coating liquid at each end of the stroke of mechanism 146. The gap between the deflector plates controls the coating width on roll 120, and the plates drain excess coating liquid into a collection trough 150.

Figure 8:
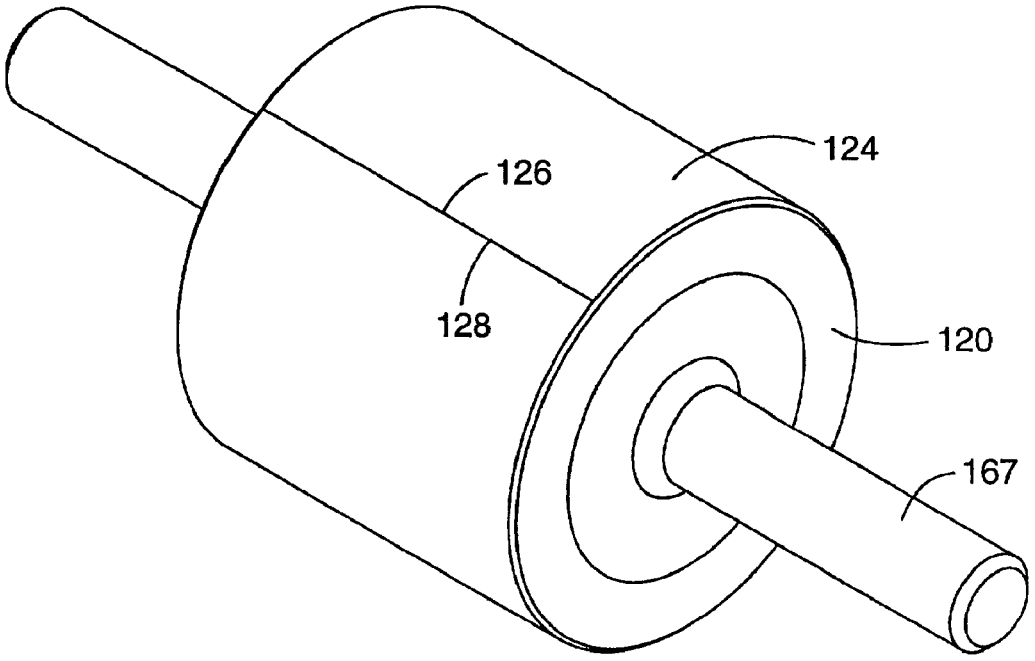
FIG. 8 is a perspective view of a sheet of limited length mounted upon a rotatable support.

FIG. 8 is a perspective view of a sheet 124 of limited length mounted upon rotatable mounting roll 120. As shown in FIG. 8, the ends 126, 128 of sheet 124 are placed in abutting relationship. However, the ends 126, 128 can overlap as shown in FIG. 7 or can have a small gap between them if desired. Axle 167 supports roll 120.

Figure 9:
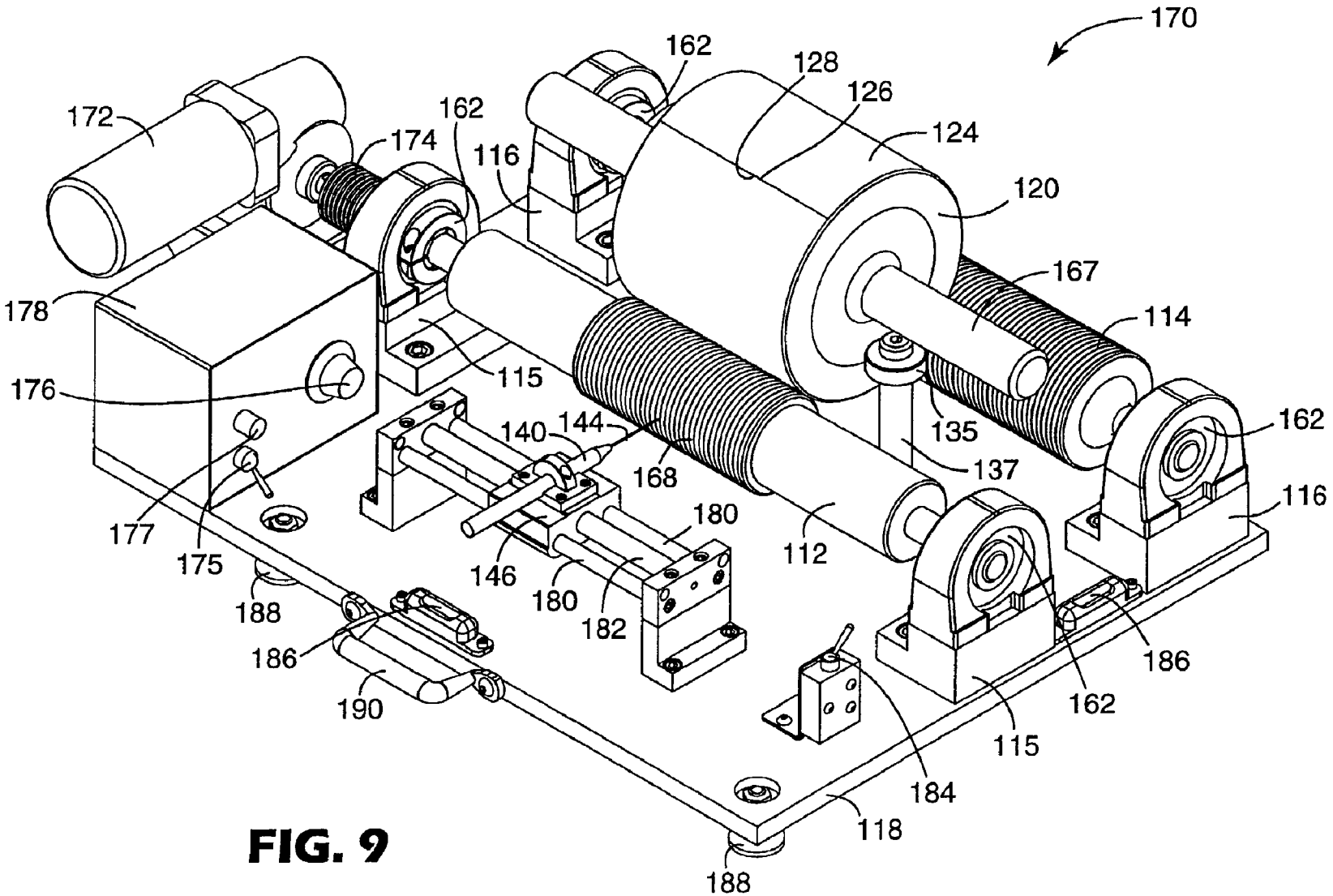
FIG. 9 is a perspective view of a device of the invention for coating substrates of limited length.

FIG. 9 is a perspective view of a device 170 of the invention. Device 170 is like device 110 of FIG. 7, but is designed so that the coating liquid is applied to a raised portion 168 on coating rod 112 rather than to sheet 124 on roll 120. Device 170 is portable and can be used, for example, on a benchtop. Roll 120 lies between and is supported by coating rods 112 and 114. Coating rods 112 and 114 are carried by low friction bearings 162 in pedestals 115 and 116, respectively atop base 118. Rotating retainer stop 135 atop support post 137 limits sideways movement of roll 120. Rotating force is supplied to coating rod 112 by variable speed drive motor 172 operating through coupling 174. The speed of rotation of motor 172 (and thence of coating rod 112) is controlled using power switch 175 and potentiometer 176 in housing 178. Pilot light 177 indicates that motor 172 is energized. Oscillating mechanism 146 moves supply line 140 and needle 144 back and forth along rails 180 due to the action of rotating spiral wound lead screw 182. Power switch 184 and a conventional speed regulation device (not shown in FIG. 9) regulate the speed of lead screw 182 and the rate of oscillation of mechanism 146. Bubble levels 186 and leveling screws 188 assist in leveling device 170. Handle 190 enables device 170 to be moved by hand from place to place.

The basic principles of operation of the devices shown in FIG. 7 through FIG. 9 are further described in pending U.S. patent application Ser. No. 10/044,276 filed even date herewith and entitled SHEET COATER, the entire disclosure of which is incorporated by reference herein. Sample sheet coating can be accomplished using such devices by initially mounting sheet 124 on roll 120 using a suitable mounting technique. If sheet 124 has suitable dielectric properties, then static electrical forces usually will be sufficient to hold sheet 124 in place without other fastening measures being required. Next, roll 120 is placed adjacent coating rods 112 and 114 (and other coating rods if present), so that sheet 124 is nipped between roll 120 and the coating rods. The total volume of coating liquid needed to achieve the desired coating caliper can be calculated in advance. Assuming equal film splits at the nip points, e.g., the nip points 132 and 134 in FIG. 7, the total coating liquid volume will equal the desired caliper times the wetted surface area. This wetted surface area will equal the wetted surface of all the coating rods, e.g., coating rods 112 and 114, plus the wetted surface on roll 120. The desired volume of coating liquid is next applied as one or a plurality of liquid stripes across the length of at least one of the coating rods, e.g., coating rod 112 or 114, or across the face of sheet 124 on roll 120. The coating liquid application can conveniently be carried out by flowing the coating liquid through needle 144 while needle 144 traverses back and forth. By varying the number of stripes and the flow rate from needle 144, to desired final caliper on sheet 124 can be very accurately controlled. The applied coating liquid stripes can be placed in random or in specific locations on a coating rod or rods or on sheer 124. Improved uniformity for a set number of rotations can be achieved if the stripe width and placement are appropriately optimized. Stripe coating is preferred over attempting to apply a uniform coating to a coating rod or to sheet 124. because it is much easier to apply a nonuniform coating of thicker stripes than to apply a uniform thin coating. The flow rate of the liquid preferably is held constant during application in order to promote good cross web uniformity in the final coating. The initial lengthwise uneven coating on the coating rod or on shoot 124 is converted to a uniform coating by causing roll 120 to revolve for a plurality of revolutions, whereupon wetted and to be wetted surface portions of the sheet 124 and the coating rods will contact and re-contact one another at successively different positions. This causes the coating liquid to be picked up from and replaced onto the sheet 124. The coating quickly becomes much more uniform. For example, in the device shown in FIG. 9, when the variable speed drive motor 172 is energized then the coating rods 112 and 114 and mounting roll 120 all rotate at approximately the same surface speed. A very uniform caliper coating is obtained by rotating roll 120 for a suitable number of revolutions (e.g., 10 or more, 20 or more or even 100 or more revolutions) and by exercising appropriate control of the applied stripe width arid coating rod periods of rotation. Following completion of the desired number of revolutions, sheet 124 is removed from roll 120 and permitted to dry or harden if required. To assist in removal of sheet 124, roll 120 can be lifted away from the device of the invention and placed on a suitable stand or benchtop. However, due to the weight of roll 120, it may be somewhat difficult to pick up roll 120 by band. The devices of the invention can be equipped with a suitable lifting device (e.g., pneumatically-operated lifting jacks that raise roll 120) to assist in removal of sheet 124.

For any of the devices of the invention, coating liquid behaviors such as drying, curing, gelation, crystallization or a phase change occurring with the passage of time may impose limitations. If the coating liquid contains a volatile component, the time necessary to achieve hundreds or thousands of coating rod revolutions may allow drying to proceed to an extent that the liquid may solidify. A phase change for any reason while the coating rods are in contact with the substrate usually results in disruptions and patterns in the applied coating. Therefore, it is generally preferable to produce the desired degree of coating uniformity in as few revolutions as possible.

Further performance improvements can be obtained in devices of the invention by operating the coating rods at variable speeds using a periodic or random speed differential. Speed variation can be accomplished, for example, by independently driving the rolls with separate motors and electrically varying the motor speeds. Those skilled in the art will appreciate that a variety of mechanical speed variation devices can also be employed, including variable speed transmissions, belt and pulley or gear chain and sprocket systems in which a pulley or sprocket diameter is changed, and limited slip clutches or braking to slow the period of rotation. Other techniques for varying the rotational period of the surface of a rotating body relative to another rotating body include varying the size of the first body while holding its surface speed constant (e.g., by inflating or deflating or otherwise expanding or shrinking the mounting roll 120 in the device shown in FIG. 9). If the wire-wrapped coating rods are constructed from a thermally expanding material, then the coating rod sizes (and the coating rod periods) can also be modified by operating the coating rods at differing temperatures. Also, the position of a coating rod can be varied during operation. For example, a force can be applied to the end of and parallel to shaft 16 of coating rod 15 to cause coating rod 15 to oscillate back and forth relative to web 10 of FIG. 1. This movement will induce sideways, cross-sheet movement of liquid and improve overall coating uniformity, especially if the web was initially coated with a stripe that was not sufficiently uniform across the width of the web. All of the above variations are useful, and all can be used to affect and improve the performance of the devices and methods of the invention and the uniformity of the caliper of the finished coating.

A variety of speed variation functions can be employed, e.g., random or controlled variations, including variations having a periodic or non-periodic nature, random walks, linear ramp functions in time and intermittent changes. All can be used to lessen the number of coating rods or coating rod revolutions required to produce uniform coatings on substrates. Very small variations in the coating rod periods of rotation or surface speeds have been found to be especially useful. For example, in the device shown in FIG. 7 through FIG. 9, a preferred mode of speed variation is to vary the surface speed differential between a coating rod 112 or 114 and mounting roll 120 sinusoidally as roll 120 is revolved. Improved results are obtained with small speed variations having amplitudes as low as 0.5 percent of the average. Often it is desirable to avoid larger amplitude variations, especially when large numbers of revolutions of roll 120 are employed, in order to avoid heat generation from excessively high speed differentials.

The coating liquid can initially be applied in a variety of uneven patterns other than stripes, and by using methods other than to osculating needle applicators discussed above. For example, a pattern of droplets can be sprayed onto the substrate or onto a coating r&d using a suitable non-contacting spray head or other drop-producing device. Examples of suitable drop-producing devices include point source nozzles such as airless. electrostatic, spinning disk and pneumatic spray nozzles. Line source atomization devices are also known and useful. The droplet size may range from very large (e.g., greater than 1 millimeter) to very small. The nozzle or nozzles can be oscillated back and forth, e.g, in a manner similar to the above-described needle applicator. Particularly preferred drop-producing devices are described in pending U.S. patent application Ser. Nos. 09/841,380 entitled ELECTROSTATIC SPRAY COATING APPARATUS AND METHOD and Ser. No. 09/841,381 entitled VARIABLE ELECTROSTATIC SPRAY COATING APPARATUS ANT) METHOD (now U.S. Pat. No. 6,579,574 B1), both filed Apr. 24, 2001, the entire disclosures of which are incorporated by reference herein.

The benefits of the present invention can be tested experimentally or simulated for each particular application. Many criteria can be applied to measure coating uniformity improvement. Examples include caliper standard deviation, ratio of minimum (or maximum) caliper divided by average caliper, range (defined as the maximum caliper minus the minimum caliper over time at a fixed observation point), and reduction in void area. For example, through the use of the present invention, range reductions of greater than 75%, greater than 80%, greater than 85% or even greater than 90% can be obtained. For discontinuous coatings (or in other words, coatings that initially have voids), the invention enables reductions in the total void area of greater than 50%, greater than 75%, greater than 90% or even greater than 99%. The application of this method can produce void-free coatings. Those skilled in the art will recognize that the desired degree of coating uniformity improvement will depend on many factors including the type of coating, coating equipment and coating conditions, and the intended use for the coated substrate.

Through the use of the invention, 100% solids coating compositions can be converted to void-free or substantially void-free cured coatings with very low average calipers. For example, coatings having thicknesses less than 5 micrometers can readily be obtained. Coatings having thicknesses greater than 5 micrometers can also be obtained. In such cases the wire-wrapped surfaces of the coating rods are especially useful for accommodating the increased wet coating thickness.

A coating having random or periodic areas that are deficient in coating material can be analyzed by considering the coating to be made up of a uniform base coating underneath a voided coating of the same composition. The devices described herein will act to remove and reposition the top voided coating in a manner similar to their action on a lone voided coating. Thus the teachings provided herein for a voided coating also apply to a non-voided but non-uniform coating containing coating depressions. In a similar manner periodic or random excesses in a coating can be analyzed by considering the coating to be made up of a uniform base coating underlying a discontinuous top coating. Thus the teachings provided herein for a voided coating also apply to a non-voided but non-uniform coating containing coating surges.

Another aspect of the invention is that the devices and methods of the invention increase the rate of drying volatile liquids on a substrate. Drying is often carried out after a substrate has been treated by washing or by passage through a treating liquid. Here the main process objective is not to apply a liquid coating, but instead to remove liquid. For example, droplets, patches or films of liquid are commonly encountered in operations such as plating, coating, etching, chemical treatment, printing and slitting, as well as washing and cleaning in the electronics industry. When a liquid is placed on or is present on a substrate in the form of droplets, patches, or coatings of varying uniformity and if a dry substrate is desired, than the liquid must be removed. This removal can take place, for example, by evaporation or by converting the liquid into a solid residue or film. In industrial settings drying usually is accomplished using an oven. The time required to produce a dry substrate is constrained by the time required to dry the thickest caliper present. Conventional forced air ovens produce uniform heat transfer and do not provide a higher drying rate at locations of thicker caliper. Accordingly, the oven design and size must account for the highest anticipated drying load.

The devices and methods of the invention greatly increase the rate of substrate drying, and substantially reduce the time required to produce a dry substrate. Without intending to be bound by theory, the repeated contact of the wet coating with the coating rods is believed to increase the exposed liquid surface area, thereby increasing the rate of heat and mass transfer. The repeated splitting, removal and re-deposition of liquid on the substrate may also enhance the rate of drying, by increasing temperature and concentration gradients and the heat and mass transfer rate. In addition, the proximity and motion of the coating rods to the wet substrate may help break up rate limiting boundary layers near the surface of the wet coating. All of these factors appear to aid in drying.

The devices and methods of the invention can be used to apply, make more uniform or dry coatings on a variety of flexible or rigid substrates, including paper, plastics, glass, metals and composite materials. The substrates can have a variety of surface topographies including smooth, textured, patterned, microstructured and porous surfaces (e.g., smooth films, corrugated films, prismatic optical films, electronic circuits and nonwoven webs). The substrates can have a variety of uses, including tapes, membranes (e.g., fuel cell membranes), insulation, optical films or components, electronic films, components or precursors thereof, and the like. The substrates can have one layer or many layers under the coating layer. The various embodiments of the invention are especially useful for making 100% solids coatings, precision coatings and extremely thin coatings. The embodiments of the invention shown in FIG. 7 through FIG. 9 are especially useful for quickly evaluating a series of coated substrates prior to scale-up of large-scale web manufacturing processes, for preparing calibration standards, and for modifying the optical, chemical, mechanical or electrical properties of a sheet surface without resorting to hand spreads or to extreme dilution of a coating formulation with solvents or water.

The invention can also be used to produce one or more distinct lanes of coating on a substrate. Thus the invention can provide, for example, a single lane of coating on the substrate bordered on one or both sides by a lane or lanes without coating. The invention can also provide two or more lanes containing the same or two or more differing formulations separated by a lane or lanes without coating. The invention can also provide two or more adjacent lanes containing two or more differing formulations. Because the amount of applied coating liquid can be premetered to prevent or discourage the formation of rolling banks of liquid behind the coating rods, cross web mixing and lane edge deterioration are prevented or discouraged. In contrast, in conventional Mayer rod coating an excess of coating liquid typically is applied, and it is difficult to form distinct lanes of coating. Instead, lane edge deterioration or cross web mixing occurs in the rolling bank or banks of liquid behind the coating rod.

Although the invention has been described by referring to wire-wound coating rods, other suitably non-smooth coating rod structures can be used to obtain equivalent results. For example, a series of parallel radial cuts or a single spiral groove can be cut in a cylindrical coating rod. When doing so, the results will in general approximate those obtained using a wire-wound coating rod having the same volume factor. For a wire-wound coating rod, the volume factor is the volume of liquid per unit area trapped between the exposed wire surface on the coating rod and a smooth cylindrical opposing surface that just touches the outside of the wire winding. For a grooved rod, the volume factor is the volume of liquid per unit area trapped in the grooves when a smooth cylindrical opposing surface just touches the rod. Other non-smooth rod structures can be similarly characterized according to their surface volume factors and used in substitution for wire-wound coating rods. However, in view of the low cost and ready availability of wire-wound coating rods, other non-smooth rod structures are clearly less preferred.

The invention is further illustrated in the following example, in which all parts and percentages are by weight unless otherwise indicated.

EXAMPLE

Using a modified coating machine equipped with an improvement station of the invention, a plastic web was coated with intermittent, periodic and sparsely applied cross web stripes of a coating liquid, then converted to a web having a continuous uniform coating. The web was 0.05 mm thick and 153 mm wide biaxially oriented polyester film. The coating liquid contained 2600 parts by volume of glycerin, 260 parts by volume of isopropyl alcohol, and 1 part by volume of a fluorochemical wetting agent (3M™ FLUORAD™ FC-129 fluorosurfactant, Minnesota Mining and Manufacturing Company, St. Paul, Minn.). The coating liquid was applied directly to the web. The coating station employed an air driven oscillating mechanism that stroked a flexible polypropylene needle back and forth across the transfer roll. The oscillating mechanism was a Model BC406SK13.00 TOLOMATICT Pneumatic Band Cylinder with a linear actuator (Tol-O-Matic, Inc., Hamel, Minnesota). The coating liquid was premetered using a gear pump with 2.92 cc/rev capacity. The polypropylene needle had a 0.48 mm tip and was obtained as part number 560105 from I & J Fisnar Inc. of Fair Lawn, N.J. Interconnection between the syringe pump and the needle was made using flexible, 4 mm OD plastic tubing. The needle was positioned so that the needle tip contacted the web. Using a web speed of 3.5 meters per minute, a liquid flow rate controlled by the metering pump rate, a stroke rate of 40 per minute and a stroke length of 127 mm, a pattern of narrow stripes was premetered onto the web.

The coated web was then brought into contact with an improvement station containing four wire-wound coating rods, two back side idler rolls and then three more wire-wound coating rods. The coating rods contacted the stripe-coated side of the web. The coating rods had been obtained from the Specialty Coating Company of Rochester, N.Y. The coating rod shafts were 12.7 millimeters in diameter. Because the stripes approaching the first coating rod have a very thick caliper and are reduced in caliper as they pass each subsequent coating rod, a progression of smaller and smaller wire diameters or rod sizes is preferred, at least until a continuous coating is achieved. Accordingly, coating rods one through seven were wound with number 75, 50 36, 34, 30, 24, and 22 gauge wire respectively. Each end of the coating rods was mounted in a free running ball bearing so that the coating rod could rotate with the web in response to web traction. The web path was set so the first, fourth, fifth and seventh coating rods contacted the web at a 30° wrap angle and the second, third and sixth coating rods contacted the web at a 90° wrap angle.

Flow rates of 38 to 73 milliliters per minute were continuously supplied to the oscillating needle applicator. The flow continued as the needle traversed beyond the web edges on each stroke. Excess coating liquid was deposited into a collection pan extending beyond the web edges at the needle applicator position. At flow rates above 41 milliliters per minute, rolling banks of liquid accumulated behind some of the coating rods and dripped from the edge of the web. By decreasing the flow rate to about 38 to 41 milliliters per minute, stable coating was achieved and the applied liquid remained on the web as it passed the coating rods. At these flow rates, half the pump flow rate was deposited upon the web and half was deposited into the collection pan.

Following passage through the improvement station, the very discontinuous initially applied coating was transformed to a continuous, void-free coating. The improvement could be seen by visibly inspecting the web before and after each coating rod. At the first coating rod a diagonal, cross web stripe approached and then passed beneath the co-rotating coating rod. Upon exiting from the web-to-rod contact zone, a portion of the liquid remained on the surface of the first coating rod and a portion remained with the web. The liquid stripe was transformed into two separate images, one on the first coating rod and one on the web. The image on the first coating rod subsequently recontacted a new position on the web as the first coating rod revolved one revolution, creating a second image upon the web with reduced caliper. In a similar manner the coating liquid stripe and its subsequent images were split between the web and the remaining coating rods, recontacted the web at new locations, and produced additional images with further reduced calipers. This repeating contacting, splitting and re-contacting produced a continuous void-free coating with excellent caliper uniformity.

As with conventional Mayer rod coating, there may be a tendency to produce down-web lines in the coating because of the presence of the wires. For coatings of an appropriate viscosity such lines will self-level. If they do not self-level, those skilled in the art of coating will recognize that post-treatment using smoothing blades or other devices may be useful to reduce or eliminate the lines.

Various modifications and alterations of this invention will be apparent to those skilled in the art without departing from the scope and spirit of this invention. This invention should not be restricted to that which has been set forth herein only for illustrative purposes.

What is claimed is:

1. A method for improving the uniformity of a wet coating on a substrate having a direction of motion comprising:

applying to the substrate a wet coating;

contacting the applied coating at a first position with wetted surface portions of at least two rotating wire-wound pick-and-place rods; and re-contacting the coating with such wetted surface portions at positions on the substrate that are different from the first position and not periodically related to one another with respect to their distance from the first position;

whereby the coating caliper uniformity is improved in the direction of motion.

2. A method according to claim 1 wherein the rods do not have the same period of contact with the substrate.

3. A method according to claim 2 wherein the rotational periods of the rods are not periodically related.

4. A method according to claim 1 comprising at least three rods.

5. A method according to claim 4 wherein the rods all have different periods of rotation.

6. A method according to claim 4 wherein the rods have a progression of smaller and smaller wire diameters.

7. A method according to claim 1 comprising at least five rods.

8. A method according to claim 1 comprising at least ten rods.

9. A method according to claim 1 comprising applying to the substrate a discontinuous wet coating whose caliper spatially varies in the direction of motion.

10. A method according to claim 9 comprising at least four rods.

11. A method according to claim 9 comprising at least ten rods.

12. A method according to claim 1 wherein the direction of rotation of at least one of the rods is the same as the direction of substrate motion.

13. A method according to claim 12 wherein the direction of rotation of at least two of the rods is the same as the direction of substrate motion.

14. A method according to claim 12 wherein all the rods rotate in the same direction as and at substantially the same speed as the substrate.

15. A method according to claim 12 wherein the substrate comprises a web and the rods are undriven, bear against the substrate and are rotated by the motion of the substrate.

16. A method according to claim 1 wherein the substrate comprises a sheet mounted on a rotating support.

17. A method according to claim 1 further comprising changing the period of rotation of a rod during its operation to reduce or minimize coating defects.

18. A method according to claim 1 further comprising operating a rod at a fixed or variable surface speed differential relative to the substrate.

19. A method according to claim 1 comprising applying to the substrate a discontinuous or deliberately uneven wet coating whose caliper spatially varies in the direction of motion.

20. A method according to claim 19 comprising applying the coating as a pattern of cross web stripes.

21. A method according to claim 20 further comprising selecting or changing the stripe width to produce a more uniform coating.

22. A method according to claim 19 comprising applying the coating as a pattern of drops.

23. A method according to claim 1 wherein the coating is converted from a voided coating to a void-free continuous coating.

24. A method according to claim 1 wherein the coating is converted to have an average caliper less than 5 micrometers.

25. A method according to claim 1 wherein the coating comprises one or more lanes of coating on the substrate.

26. A method according to claim 25 wherein the coating comprises two or more lanes containing the same or two or more differing formulations separated by a lane or lanes without coating.

27. A method according to claim 25 wherein the coating comprises two or more adjacent lanes containing two or more differing formulations.

28. A method for improving the uniformity of a wet coating on a substrate comprising contacting the coating at a first position with wetted surface portions of at least two rotating wire-wound coating rods and re-contacting the coating with such wetted surface portions at a, different position or positions on the substrate and further comprising operating a coating rod at a fixed or variable surface speed differential relative to the substrate, wherein the surface speed differential is varied sinusoidally.

* * * * *

UNITED STATES PATENT AND TRADEMARK OFFICE

CERTIFICATE OF CORRECTION

PATENT NO. : 6,855,374 B2
DATED : February 15, 2005
INVENTOR(S) : Leonard, William K.

It is certified that error appears in the above-identified patent and that said Letters Patent is hereby corrected as shown below:

Column 1,
Line 51, delete “trough” and insert -- through --.
Line 54, delete “byte” and insert -- therefore --.
Line 54, delete “typo” and insert -- type --.
Line 64, delete “wit” and insert -- with --.
Line 65, delete “to” and insert -- the --.

Column 6,
Line 50, delete “coated-sides” and insert -- coated sides --.

Column 9,
Line 55, delete “to” and insert -- the --.
Line 58, delete “sheer” and insert -- sheet --.
Line 62, after “124” delete “.” and insert -- , --.

Column 10,
Line 1, delete “shoot” and insert -- sheet --.
Line 15, delete “arid” and insert -- and --.
Line 25, delete “band” and insert -- hand --.

Column 11,
Line 23, delete “to osculating” and insert -- the oscillating --.
Line 25, delete “r&d” and insert -- rod --.
Line 28, after “airless” delete “.” and insert -- , --.
Line 39, delete “ANT)” and insert -- AND --.

Column 16,
Line 48, after “at a” delete “,”

Signed and Sealed this

Twenty-fourth Day of May, 2005

JON W. DUDAS
*Director of the United States Patent and Trademark Office*